US006021769A

United States Patent [19]

Troncoso

[11] Patent Number: 6,021,769

[45] Date of Patent: Feb. 8, 2000

[54] ARCHERY BOW ARROW REST

[76] Inventor: Freddie Troncoso, 16990 Wildwood Dr., Montrose, Colo. 81401

[21] Appl. No.: 09/201,555

[22] Filed: Nov. 30, 1998

[51] Int. Cl.[7] ..... F41B 5/22

[52] U.S. Cl. ..... 124/44.5

[58] Field of Search ..... 124/24.1, 44.5

[56] References Cited

U.S. PATENT DOCUMENTS

| | | | |
|---|---|---|---|
| 4,332,232 | 6/1982 | Troncoso | 124/44.5 |
| 4,686,956 | 8/1987 | Troncoso | 124/44.5 |
| 5,372,119 | 12/1994 | Kidney | 124/44.5 |
| 5,421,314 | 6/1995 | Kidney | 124/44.5 |
| 5,490,491 | 2/1996 | Troncoso | 124/44.5 |
| 5,592,930 | 1/1997 | Roberts et al. | 124/44.5 |
| 5,673,678 | 10/1997 | Savage | 124/44.5 |
| 5,676,121 | 10/1997 | Bizier | 124/44.5 |

*Primary Examiner*—John A. Ricci
*Attorney, Agent, or Firm*—Donald E. Nist

[57] ABSTRACT

The improved archery bow arrow rest includes an elongated bracket having a front end portion and opposite rear end. The front portion is adapted to be secured to the sidewall of an archery bow riser on the side of the riser opposite that which defines the arrow window of the bow. The rear end of the bracket has one end of a transverse bar secured thereto, with the opposite free end of the bar extending behind the arrow window when the bracket is secured to an archery bow. The bar preferably is secured by a spring to the bracket to bias the bar against counterclockwise rotation. The rest also includes a spaced parallel pair of inflexible arrow holder arms, the rear ends of which are secured to the bar. The central portions of the holder arms extend upwardly and forwardly of the bar for positioning in the arrow window. The front portions of the holder arms are bent down to form prongs which are at an angle extending toward each other to form a V. The lower ends of the prongs are spaced apart at least about 0.125 inch to provide clear passage for an arrow vane therebetween. Each of the prongs is at an angle of about 25–30 degrees from the vertical so as to securely hold an arrow against roll-off from the rest. Preferably, the prongs are injection molded in friction-free plastic and the lower ends of the prongs preferably include removeable extensions. The lengths of the holder arms can differ to more readily accommodate arrows with helical fletching.

9 Claims, 1 Drawing Sheet

ARCHERY BOW ARROW REST

BACKGROUND OF THE INVENTION

1. Field of the Invention

The present invention generally relates to archery equipment and more particularly to an improved archery bow arrow rest.

2. Prior Art

Various types of arrow rests have been utilized to hold arrows on archery bows for shooting therefrom. Thus, some rests have been devised to reduce arrow oscillation which normally occurs during shooting and reduces shooting accuracy. The amount and type of oscillation will vary, depending on whether a conventional recurve bow is used or a compound archery bow, with a mechanical release device or using the fingers to pull the bowstring.

A special problem arises when rests are used to hold archery arrows during bowhunting. Thus, in order to effectively bowhunt it is necessary to have the arrow already on the rest and the arrow attached to the bowstring so that shooting can take place immediately when the game is sighted and within shooting range rather than having to place the arrow on the rest, thus wasting precious time in which the game can move out of range. Unfortunately, when, during bowhunting, the arrow is carried on the rest, it has always been necessary to carry the bow vertically in order to prevent the arrow from rolling off the rest. This is difficult, because it is tiring and a nuisance to carry the bow in that position, especially through underbrush and in rough terrain. There is always a danger that the undergrowth will strike the arrow and push it off the rest. Moreover, certain clear shots at the game animal could be made if it were possible to tilt the bow to clear obstacles and then make the shot in the tilted position. However, prior attempts to solve this problem in a useful way have been unsuccessful. With the advent of mechanical string releases, many archers began to use narrow width launcher type rests, making the roll-off problem even more prevalent.

Accordingly, there is a need for a new type of arrow rest which positively holds the arrow on the rest ready for shooting, whether or not the bow is in a vertical shooting position and regardless of the type of bow used and the manner in which the bowstring is pulled and released. The rest should be simple and inexpensive to make and use and should be durable. Moreover, it would be desireable if the rest could dampen arrow oscillation so as to improve shooting accuracy.

SUMMARY OF THE PRESENT INVENTION

The improved archery bow arrow rest of the present invention satisfies all the foregoing needs. The rest is ideally suited for bowhunting, field archery and target archery as well. The rest can be used on recurved and compound bows and with mechanical releases or finger pulling of the bowstring. It dampens arrow oscillations and effectively eliminates the necessity of using depressible side plungers to dampen arrow oscillations.

The rest comprises a novel pair of parallel arrow holder arms which positively hold the arrow against roll-off regardless of whether the archery bow is tilted or not. The holder arms are inflexible and elongated, and are adapted to extend into the bow arrow window, with the rear ends thereof connected to the front of the free end of a transverse bar positioned behind the arrow window.

The opposite end of the bar is secured to the rear end of a bracket adapted to be connected at its front end to the sidewall of the bow riser on the side opposite that defining the bow arrow window. The bar is preferably spring biased against counterclockwise rotation. Thus, during shooting of the arrow the holder arms rotate counterclockwise with the bar against the spring biasing, dampening arrow oscillation.

Each holder arm has an elongated central or intermediate portion and a front portion bent downwardly therefrom, preferably at about a 90 degree angle, to form a prong. The prongs are straight sided and slope at angle toward each other, the angle being preferably about 25–30 degrees from the vertical for each prong, for a combined angle of about 50–60 degrees, forming a V, with the lower ends of the prongs being spaced apart at least about 0.125 inch, in order to provide clearance for a vane of the arrow when the arrow is shot from the rest. Preferably, the prongs are injection molded in essentially friction-free plastic or the like to increase arrow speed.

The V formed by the prongs cradles the arrow shaft securely and prevents its roll-off even when the bow is tilted from the vertical at a substantial angle. Moreover, the inner sides of the prongs suppress lateral oscillation and vertical oscillation of the arrow when it is shot from the rest. An additional important feature of the rest is that the prongs permit arrows of various diameters and wall thicknesses to be easily shot from the rest. All that need be done is to make a minor adjustment in the heighth of the nock point, that is, the point at which the arrow nock attaches to the bowstring.

An additional important feature is that a single cavity mold can be used to form the holder arms, because these two arms are identical. Moreover, the same rest can be used by both lefthanded and right-handed archers. This substantially reduces manufacturing costs for the rest and inventory costs. Since the holder arms are inflexible and durable, they do not wear down in use. When it is desired to adjust the spacing between the lower ends of the prongs, this can be done by attaching extensions thereto.

In one embodiment of the invention, the lengths of the two arms differ from each other so that the space between the lower ends of the prongs can more readily accommodate the use of helically fletched arrows instead of conventional straight fletched arrows.

For special uses such as bowfishing, where heavier arrows are used, spring biasing can be eliminated from the securement of the transverse bar to the bracket of the rest and the securement can be rigid.

Further details of the improved arrow rest of the present invention are set forth in the following detailed description and accompanying drawings.

DRAWINGS OF THE EMBODIMENTS OF OF THE INVENTION

Figure 1:
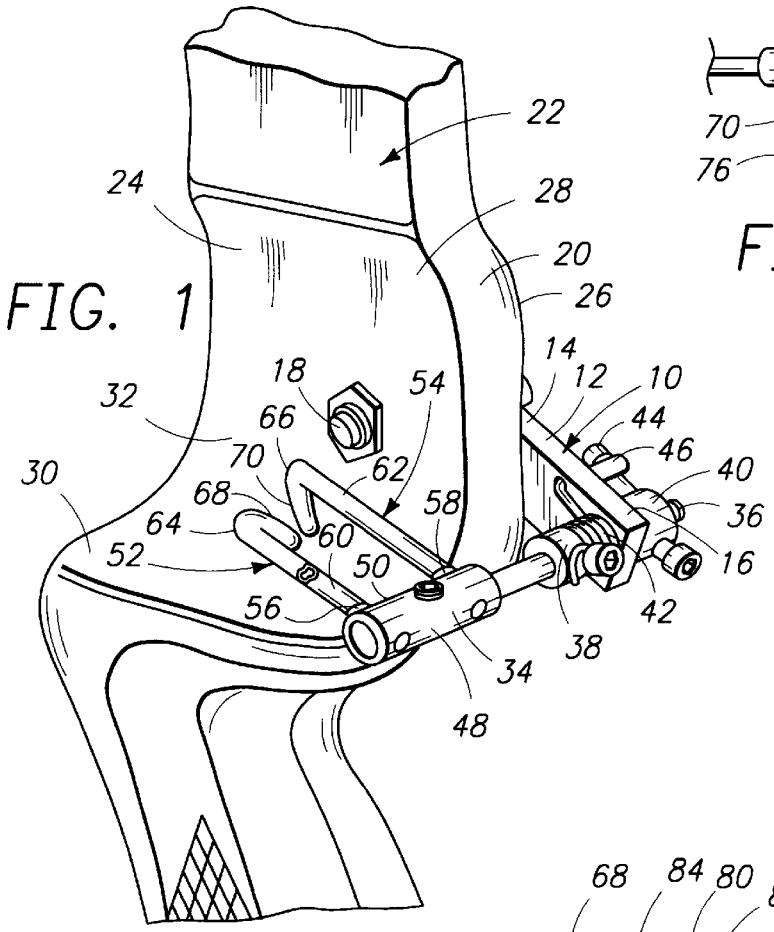
FIG. 1 is a schematic side perspective view of a first preferred embodiment of the improved archery bow arrow rest of the present invention, showing the rest mounted on an archery bow.
Figure 4:
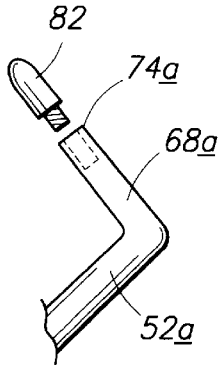
Figure 3A:
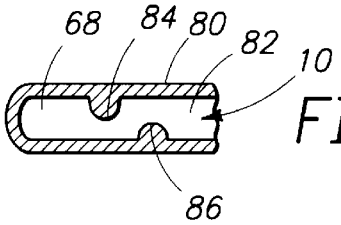
FIG. 3 is a schematic side elevation of the left-hand side of the arrow rest of FIG. 1.
Figure 5:
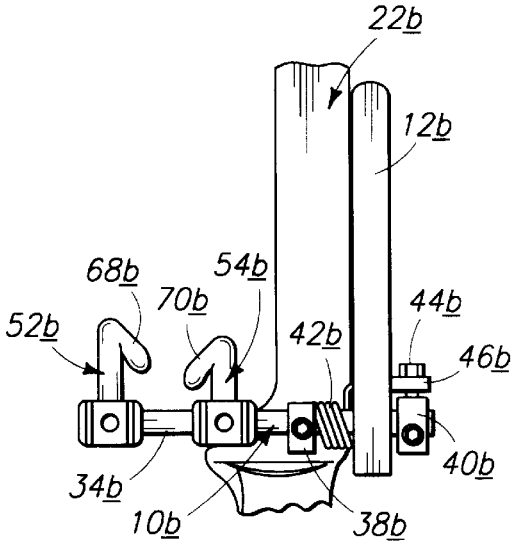

FIG. 3*a* is an enlarged fragmentary schematic longitudinal cross-sectional view of one of the prongs of a holder arm of the arrow rest of FIG. 1, showing the cover thereof locked to the core thereof;

FIG. 4 is an enlarged, fragmentary schematic perspective view of a modified version of the prong portion of one of the two arrow holders of the arrow rest of the present invention; and, FIG. 5 is a schematic rear elevation of a further embodiment of the improved arrow rest of the present invention.

DETAILED DESCRIPTION OF THE EMBODIMENTS

FIGS. 1–3 and 3*a*:

FIGS. 1–3 and 3*a* set forth in schematic detail the first preferred embodiment of the improved archery bow arrow rest of the present invention. Thus, arrow rest 10 is shown, which includes an elongated bracket 12 having a front portion 14 and an opposite rear end 16, together with a bolt 18 which passes transversely through front portion 14 and transversely through sidewall 20 of archery bow 22 in the riser section 24 thereof, from side 26 to opposite side 28, the latter of which defines with shelf 30 of bow 22 an arrow window 32, as shown in FIG. 1.

Rear end 16 of bracket 12 extends rearwardly of bow 22. Arrow rest 10 further includes a transverse bar 34, one end 36 of which passes through end 16 and is connected thereto by lock nuts 38 and 40 for rotation therearound. In this regard, a spring 42 is disposed between lock nut 38 and rear end 16 of bracket 12, one end of spring 42 being connected to lock nut 38 and the other end of spring 42 being connected to rear end 16. It will be understood that, if desired, spring 42 can be eliminated and end 36 of bar 34 can be releasably rigidly connected to rear end 16 of bracket 12.

Spring 42 is wound in a fashion which biases bar 34 for rotation in a clockwise direction, but such rotation is limited by a screw 44 connected to and extending forwardly of lock nut 40 which bears against a limit pin 46 extending outwardly from side 26 of sidewall 20, as shown in FIG. 1.

Figure 3:
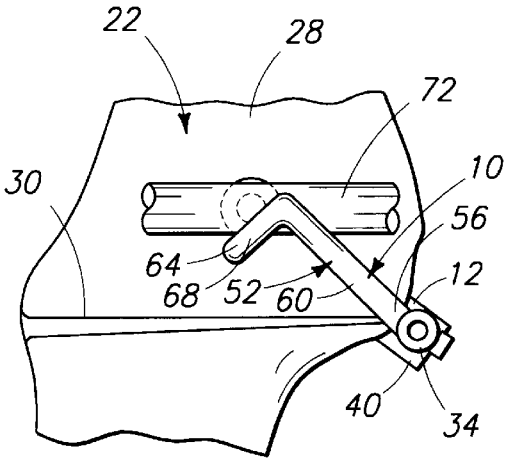

The free end 48 of bar 34 extends behind arrow window 32 when arrow rest is in place on bow 22, as shown in FIG. 1, and carries on the front portion 50 thereof a spaced pair of parallel arrow shaft holder arms, each of which extends straight forwardly and upwardly thereof into window 32, also as shown in FIGS. 1 and 3. Arms 52 and 54 preferably are about circular in transverse crosssection and are inflexible and of durable metal, such as steel or the like, or similar rigid durable material.

The rear ends 56 and 58 of arms 52 and 54 are removeably and adjustably connected to free end 48 of bar 34. Moreover, the position of arms 52 and 54 in window 32, that is, the lateral spacing thereof from sidewall 20 can be adjusted by sliding bar 34 to the proper position and locking it in place by lock nuts 38 and 40.

Arms 52 and 54 are of equal length and have elongated intermediate or central portions 60 and 62 integral with rear portions 52 and 54 and also have front portions 64 and 66 integral with intermediate portions 60 and 62. Front portions 64 and 66 are bent down preferably at about a 90 degree angle to portions 60 and 62 ( see FIG. 3) and incline or slope toward each other to form a pair of straight sturdy prongs 68 and 70 which form a V-shaped configuration when viewed from the front thereof (see FIG. 2).

Figure 2:
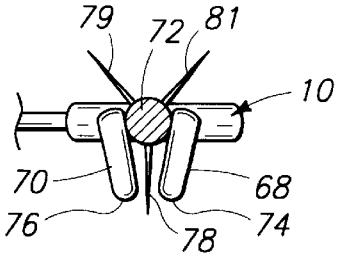
FIG. 2 is a fragmentary schematic front elevation of the arrow holder portion of the rest of FIG. 1, showing an arrow mounted thereon.

Thus, each prong is sloped at about 25–30 degrees from the vertical, so that the combined angle between prongs 68 and 70 is about 50–60 degrees. Although other angles of inclination could be used, this steep angle assures that an arrow, such as arrow 72 (see FIG. 2), when seated between prongs 68 and 70, is held securely therein so that roll-off of arrow 72 from rest 10 cannot occur, even if bow 22 is tilted at a severe angle from the vertical. This represents a substantial improvement over the prior art and is especially useful when bow 22 is used in bowhunting applications. It will also be noted that the lower ends 74 and 76 of prongs 68 and 70 must be spaced apart a sufficient distance, preferably at least about 0.125 inch, to permit a vane 78 of arrow 72 to easily pass therethrough (see FIG. 2) when arrow 72 is shot from rest 10. The other vanes 79 and 81 are above the level of holder arms 52 and 54, as shown in FIG. 2.

Because arms 52 and 54 are simple in design and identical in configuration, they can be made easily, thus saving manufacturing costs. Moreover, rest 10 can be used by both left-handed and right-handed archers, so that inventory costs can also be reduced.

Preferably, arms 52 and 54 are sheathed in a flexible resilient low friction or essentially frictionless durable cover 80 of silicone plastic or the like in an inexpensive single cavity mold in a plastic molding operation to increase the speed of arrow 72 when shot from rest 10, thus increasing its accuracy and suppressing sound which might otherwise startle game being shot. In order to prevent cover 80 from rotating around metal core 82 of prongs 68 and 70, core 82 has depressions or notches 84 and 86 on opposite sides thereof, as shown in FIG. 3*a*, thus locking cover 80 to core 82 in the molding operation.

Another substantial advantage of rest 10 is that prongs 68 and 70 act as side pressure points which suppress lateral oscillation of arrow 72 as it is being shot, while the resistance of prongs 68 and 70 to counterclockwise depression thereof during shooting, due to the biasing action of spring 42 in a clockwise direction, dampens vertical oscillation of arrow 72, thus increasing shooting accuracy and enabling arrows of various diameters and stiffness to be shot from rest 10 without adjusting anything other than the nock point of the arrow on the bowstring. Accordingly, rest 10 has both novel and substantial advantages over the prior art.

FIG. 4:

A modified version of the holder arms of the arrow rest of the present invention is shown in FIG. 4. Thus, arm 52*a* is shown which is identical to arm 52, except that prong 68*a* thereof differs from prong 68 in that lower end 74*a* thereof has a threaded extension 82 which can be screwed into end 74*a* to increase the length of prong 68*a*, when desired.

FIG. 5:

A further embodiment of the improved archery bow arrow rest of the present invention is schematically depicted in FIG. 5. All components thereof which are substantially identical to those of arrow rest 10 bear the same numerals but are succeeded by the letter "b". Thus, arrow rest 10*b* is shown in FIG. 5.

Rest 10*b* differs from rest 10 only in that arms 52*b* and 54*b* are of different effective lengths, so that instead of the front ends of prongs 68*b* and 70*b* being in the same transverse plane, as in rest 10 for prongs 68 and 70, the front ends of prongs 68*b* and 70*b* are staggered in order to more easily accommodate arrows with helical fletching. If desired, the actual lengths of arms 52*b* and 54*b* can be identical, but their effective lengths can be adjusted during connection to bar 34*b*. Rest 10*b* has all the advantages of rest 10.

Various other modifications, changes, alterations and additions can be made in the improved arrow rest of the present invention, its components and parameters. All such modifications, changes, alterations and additions as are within the scope of the accompanying claims are part of the present invention.

What is claimed is:

1. An improved archery bow arrow rest, said rest comprising, in combination:

a) a bracket comprising:

i. a bracket arm having a rear end and a front portion extending forwardly therefrom and adapted to be secured to the side wall of an archery bow, having an arrow window, on the side of said wall opposite that defining said arrow window, and ii. a transverse bar having one end thereof secured to said rear end of said bracket arm and having an opposite free end adapted to be positioned behind said arrow window; and, b) an arrow holder comprising a pair of inflexible spaced parallel holder arms, each said holder arm having a rear end secured to said bar, an elongated central portion adapted to project into said arrow window and a front portion, each said front portion comprising a prong having straight sides and sloping in a straight line down from said central portion at a steep angle from the vertical, said two prongs forming a V, the lower ends of said prongs being spaced apart a sufficient distance to allow the passage of an arrow vane therebetween, whereby an arrow, when placed on said holder, is securely cradled between said prongs to prevent roll-off of said arrow when said bow is tilted from the vertical.

2. The improved arrow rest of claim 1 wherein said lower ends of said prongs are spaced apart at least about 0.125 inch, and wherein said bar is spring biased against counter-clockwise rotation.

3. The improved arrow rest of claim 2 wherein each said prong slopes downwardly from said central portion of said holder arm at an angle of about 25–30 degrees from the vertical, the angle between said two prongs being collectively about 50–60 degrees.

4. The improved arrow rest of claim 3 wherein said front portions of said holder arms are injection molded in smooth flexible resilient plastic to facilitate non-frictional sliding of an arrow when in contact therewith.

5. The improved arrow rest of claim 4 wherein the front ends of said prongs include removeable extensions.

6. The improved arrow rest of claim 4 wherein said front portions of said holder arms comprise a metal core having spaced notches on opposite sides thereof and said plastic in the form of a covering molded over and locked to said core through said notches.

7. The improved arrow rest of claim 1 wherein said prongs are bent at an angle of about 90 degrees from the plane of said central portions of said holder arms.

8. The improved arrow rest of claim 1 wherein said two holder arms are of the same length, so that said lower ends of said prongs extend to the same forward position in a line transverse of said bracket.

9. The improved arrow rest of claim 1 wherein said two holder arms are of different lengths so that the lower end of one of said prongs extends to a position forwardly of the lower end of the other of said prongs, so that the space therebetween is at an angle to the transverse in order to more readily accommodate arrows having helical fletching.

* * * * *